United States Patent [19]

Bruner

[11] Patent Number: 4,931,606

[45] Date of Patent: Jun. 5, 1990

[54] KEY SWITCH MECHANISM AND MEMBRANE ACTUATOR

[75] Inventor: David A. Bruner, Versailles, Ky.

[73] Assignee: International Business Machines Corporation, Armonk, N.Y.

[21] Appl. No.: 345,068

[22] Filed: Apr. 28, 1989

[51] Int. Cl.[5] ..... H01H 1/10

[52] U.S. Cl. ..... 200/517; 200/408; 200/521; 200/341

[58] Field of Search ..... 200/517, 329, 341, 345, 200/408, 457, 521; 267/158, 164, 165, 148, 166, 179, 180, 151, 167, 172, 173, 182

[56] References Cited

U.S. PATENT DOCUMENTS

| | | | |
|---|---|---|---|
| 4,118,611 | 10/1978 | Harris | 200/408 |
| 4,479,040 | 10/1984 | Denley et al. | 200/517 |
| 4,528,431 | 7/1985 | Coleman, III | 200/408 |
| 4,553,009 | 11/1985 | Van Zeeland et al. | 200/517 |
| 4,859,820 | 8/1989 | Gotfryd et al. | 200/517 |

FOREIGN PATENT DOCUMENTS

| | | | |
|---|---|---|---|
| 0176836 | 7/1988 | Japan | 267/167 |
| 1424065 | 9/1988 | U.S.S.R. | 200/339 |

*Primary Examiner*—Henry J. Recla
*Assistant Examiner*—Glenn T. Barrett
*Attorney, Agent, or Firm*—Laurence R. Letson

[57] ABSTRACT

A switch activator is described which is a unitary molded plastic molded coil spring and a pivot plate which pivots to act on a membrane switch when the coil spring buckles under load. The buckling of the spring is controlled by the relative placement of the axis of the spring and a pivot surface around which the top portion of the spring pivots as the spring buckles. The cross section of the spring member is limited in size so as to prevent the forming of a solid column upon compression, while at the same time accommodating the needs for molten plastic flow in the spring during molding.

9 Claims, 1 Drawing Sheet

KEY SWITCH MECHANISM AND MEMBRANE ACTUATOR

This invention relates to the field of switches and more particularly to membrane switch activation devices.

BACKGROUND OF THE INVENTION

Membrane switches are well known and used in many different environments. One of the most prevalent uses of the membrane switch is in the keyboard of office machines such as typewriters, computers, workstations or terminals. One of the types of actuators most commonly used is illustrated in E. T. Coleman U.S. Pat. No. 4,528,431, and assigned to the assignee of this invention, which comprises a pivot plate and a wire coil spring attached to the pivot plate. This type of actuator gives the operator a reliable switch closure as well as a tactile feedback to assure the operator that switch closure has occurred. A significant portion of the cost of such a keyboard is the manufacture of the springs and the assembly with the pivot plate, in a manner to assure reliability.

In this type of keyboard, as the key cap of the keyboard is depressed, the coil spring compresses and at some point the compressed spring becomes unstable and catastrophically buckles. When the spring buckle occurs, the spring creates a moment and torques the attached tenon on the pivot plate to cause the pivot plate to pivot and to exert a force downward onto the membrane switch structure to deform the top layer of the membrane switch and close the contacts.

The spring disclosed in the Coleman Patent above and also found in Harris U.S. Pat. No. 4,118,611 and assigned to the assignee of this invention, possesses several desirable characteristics. These characteristics include a physical hysteresis in the switch activator, tactile feedback, audible feedback, snap action and the inability to get the switch to change state without a tactile or audible feedback (referred to as non-teasability). These characteristics are described in the foregoing Coleman and Harris patents.

With at least eighty key positions on a small computer keyboard and some keyboards having in excess of one hundred key positions, the combining of the spring and the pivot plate into a single item and the molding of the spring of the same plastic as the pivot plate presents a significant opportunity to reduce cost and improve reliability through elimination of parts, as well as eliminating the need to control assembly and manufacturing parameters.

The molded plastic spring provides, in addition to retaining the desirable characteristics of the wire wound spring of the prior art, an opportunity to improve the acoustic characteristics of the switch activator. The wire wound springs of the prior art produce a click type noise when the spring impacts against the frame of the switch actuation mechanism. Additionally, after the impact with the frame the spring will resonate producing a ringing or twang sound. The molded plastic spring does not produce the undesirable ringing sound while retaining the click sound which is desirable for the audible feedback to communicate to the operator, the transition of the switch.

A plastic molded spring and pivot plate, while more economical, requires entirely different functional control design considerations than when dealing with the characteristics of the wire wound coil springs. The control of the buckling action of the molded spring may be controlled by the physical design of the spring and by how it engages with other parts, where the wire wound coil springs did not present these opportunities.

It is an object of the invention to more reliably actuate the membrane switch with a device that is more economical to manufacture and assemble and which yields more consistent results.

It is an additional object of the invention to eliminate undesirable characteristics of sound of the prior art while retaining the desirable characteristics of sound for audible feedback found in the prior art.

SUMMARY OF THE INVENTION

The pivot plate is made by injection molding the plate in a mold that has a communicating cavity for forming a coiled spring structure extending from the top surface of the pivot plate cavity. Thus, the spring is molded unitary with the plate. The spring is comprised of a series of coil members which are made of opposing straight segments interconnected by stepped segments to form corners of the coil. The coil is positioned so that the axis of the molded coil spring intersects the plate at a point displaced from the pivot axis of the pivot plate such that the plate is held in a stable position and is biased to cause the pivot plate to be restored or rotated toward the retracted or restored position so as to not activate the associated membrane switch as the spring is compressed prior to the buckling of the coil spring. The pivot axis is positioned relative to the axis of the coil spring and the pivot surface of the free end termination of the spring to prevent the pivoting of the pivot plate solely due to compression of the spring, but rather, only due to the catastrophic buckling failure of the spring. This results in a non-teasible, snap-action switch activator which provides tactile and audible feedback to the switch operator. A teasible switch is one which gives an audible and or tactile feedback at a time which is different than the time at which the switch makes or breaks, thus indicating to the operator that the switch made or broke at the moment of the feedback, when in fact it is not in the indicated state.

A better understanding of the invention may be had from the drawings of the invention and the detailed description below.

DRAWINGS

DETAILED DESCRIPTION OF THE INVENTION

Figure 1:
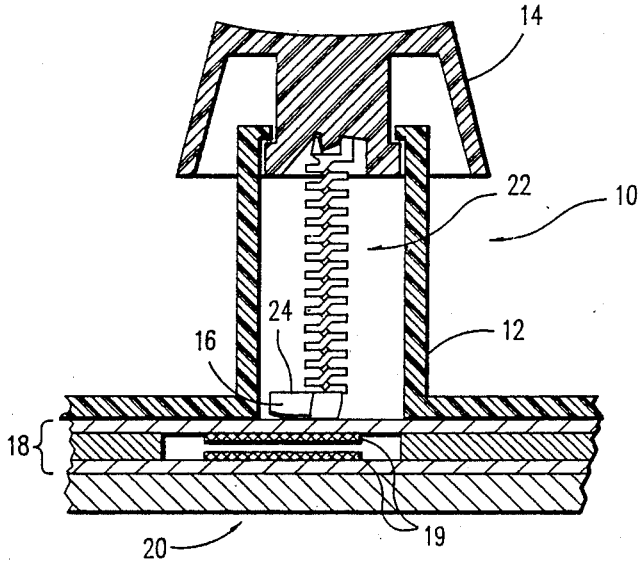
FIG. 1 is a keyboard switch and switch mechanism utilizing the invention.

Referring to FIG. 1, the switch mechanism 10 is shown. The switch mechanism is comprised of a main frame 12 and a keybutton 14, which acts as a switch control member. The keybutton 14 rides in the main frame 12 and is capable of moving in toward and out from pivot plate 16. Pivot plate 16 rests on membrane switch 18, over switch site 20. Coil spring 22, an integral part of the pivot plate 16 is formed on the top surface 24 of the pivot plate 16.

The coil of the spring 22 is of such a length that it will support the keybutton 14 in a raised position at the topmost position of travel of the keybutton 14 within the limits of travel defined by the keybutton 14 and the main frame 12. The length of the coil spring 22 should not be so long as to generate any substantial preload on the coil spring 22. Any substantial preload on the coil spring 22 will cause deformation of the plastic which is molded to form the combined pivot plate 16 and coil spring 22. If the coil spring 22 is preloaded to partially compress the spring 22, then the preload force will cause creep in the plastic and the coil spring 22, in its foreshortened state, will not buckle when further depressed by the keybutton 14. The amount of preload that is acceptable is that which will not cause the material of the spring 22 to creep.

The prior art wire wound coil spring is of sufficient length in its relaxed state that the spring is preloaded, when assembled into the keyboard assembly and confined between the keybutton and the switch, to take up some of the travel in the spring prior to buckling. This preloading of the prior art wire wound spring is necessary to render the spring unstable early in the movement of the keybutton, thereby shortening the required keybutton travel necessary to buckle the spring and pivot the pivot plate.

Figure 2:
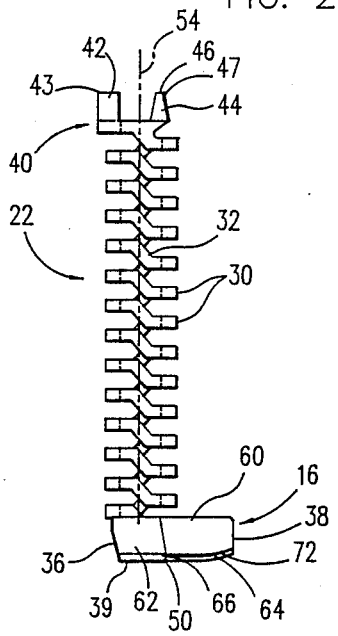
FIG. 2 is a side view of the combined pivot plate and spring of the invention.
Figure 3:
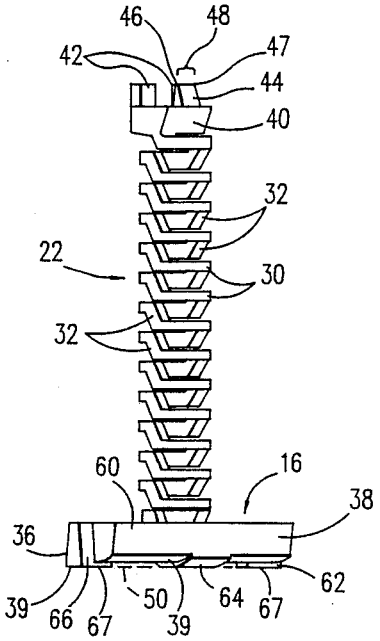
FIG. 3 is a quartering view with respect to FIG. 2 of the pivot plate and spring of the invention.

The coils of the molded plastic coil spring 22, shown best in FIGS. 2 and 3, are comprised of straight segments 30 which are connected to stepped segments 32 to form a coiled spring 22. The preferred plastic material for molding the combined spring and pivot plate is DELRIN 1700, an acetal resin marketed by DuPont Corporation. Other similar materials can be used. The thickness dimension of the straight segments 30, which are oriented in a generally horizontal orientation, is substantially equal to the distance between adjacent segments 30. This is necessary, in this embodiment, so that the molten resin will flow through the coils of the spring 22, during the molding operation. If molding parameters are such that smaller cross section dimensions are acceptable, then the smaller dimensions may prove best. In any event, the thickness dimensions of the segments 30 should not be greater than the intersegment distance to prevent the spring 22 from having insufficient space between coils to compress. If the segments 30 are greater in cross section thickness than the space between adjacent segments, the segments 30 may engage the adjacent segments 30 and become a solid column, which will not buckle within the operating forces and travel available in the operation of the keyboard.

The rear surface 36 of the pivot plate 16 does not engage the membrane switch structure or any other portion of the keyboard, either in the relaxed, restored state of spring 22 or the pivoted position of spring 22. However, the rear surface 36 of the pivot plate 16 is relieved or cut back toward the front tip 38 of the pivot plate 16. This relief is beneficial since the molding of the spring 22/pivot plate 16 from the plastic in this embodiment will leave flash in the region of the rear 36 of the pivot plate 16, extending from the junction of the rear surface 36 and the bottom 39 of the pivot plate 16. Flash may be controlled to a relatively small dimension and if the flash is smaller than the relief, then the flash will not interfere with the operation of the pivot plate 16.

In order to control the buckling of the molded coil spring 22, in a short compression, the termination 40 of the coil spring 22 is formed into three extending members comprised of two lugs 42 and opposing, larger lug 44. Lugs 42, which may be more than two, are positioned to the rear of the axis of the coil spring 22, relative to the pivot plate 16. The two lugs 42 have wide, top surfaces 45 which act to support the keybutton when the switch mechanism is in its restored, relaxed position.

The third lug 44 is configured to present a narrow top surface 46, as shown in FIG. 2, with a longer dimension 48, as shown in FIG. 3, extending parallel to the axis of rotation 50 of the pivot plate 16, also referred to as the pivot axis 50. The surface 46 engages the underside of the keybutton 14 and the outer most edge 47 of the surface 46 is the edge around which the upper portion of the coil spring 22 rotates as it buckles upon depression of the keybutton 14. This edge 46 forms a pivot or buckling axis 47 for the top portion of the coil spring 22 and is positioned within the outside dimension of the coil spring 22 and in close proximity to the axis 54 of the coil spring 22. The closer the buckling axis 47 is to the axis 54 of the coil spring 22, the more unstable coil spring 22 is in compression, affording control over the buckling of the spring 22 by design. The buckling axis 47 must be positioned forward of the spring axis 54 but within the outside dimension of the coil spring 22. The distance from axis 54 to the surface 47 controls the point at which the buckling of the spring 22 occurs in the keybutton travel. Buckling around lugs 42 will not occur because their outer surfaces are more distant from axis 54 than is edge 47.

The configuration of the pivot plate 16 is best viewed in FIG. 3. The pivot plate 16 is comprised of a support member 62 which serves as the main structure to which the coil spring 22 is attached and having outer support feet 66. Also formed as a part of the pivot plate 16 is pivot member 60 having a central protrusion 64. Support feet 66 provide the support surfaces upon which the pivot plate 16 rests in the restored or relaxed position. The front pivot edge 67 of the support feet 66 form a pivot edge 67 around which the pivot member 60 of pivot plate 16 pivots when the coil spring 22 buckles. The edges 67 constitute the pivot plate pivot axis 50.

The protrusion 64 extends downward from the bottom surface 39 of the pivot member 60 and when the pivot member 60 is pivoted about pivot edge 67, exerts all the net pivoting force onto the membrane switch to close the contacts thereof. The protrusion 64 acts to concentrate the net pivoting force into a small area to insure a reliable closure of the switch contacts 19.

As the keybutton is depressed to cause the closing of the switch contacts 19 in the membrane switch 18, the coil spring 22 is loaded in compression. The forces of the keybutton on the termination 40 of the coil spring 22, specifically the lugs 42, 44 cause the coil spring 22 to compress. The forces are generally along the axis 54 of coil spring 22, which serves to force the rear of the pivot plate 16 downward forcing the feet 66 against the top of the membrane switch 18. The forces of feet 66 do not affect the switch operation, since the feet engage the top of membrane 18 outside the switch contact area. As the compressive forces increase with the depression of the keybutton 14, the coil spring 22 column becomes increasingly unstable and buckles around edge 47. The relative distances from the axis 54 of the coil spring 22 to the lugs 42, 44 and particularly to the surface 46 or edge 47 of the lug 44 and edge 43 of lugs 42 around which pivoting could occur defines the buckling direction of the spring 22. Closing of switch contacts 19 completes an electrical circuit constituting the closing of switch 18.

While the prior art wire wound coil spring is preloaded, partially to create a degree of instability in the spring column, the instability of the molded plastic coil spring column 22 may be increased by placing the buckling axis 47 of the spring termination 40 close to the spring axis 54, thereby shifting the point of buckling to an early time in the keybutton stroke. This will insure the reliability of the switch 18 activation since there will be adequate keybutton travel available after reaching the nominal buckling point to cause reluctant springs to buckle.

I claim:

1. A switch activator for closing the contacts of a membrane switch in response to the movement of a switch control member toward said membrane switch, comprising:

a pivotable member having a first and a second surface and a pivot axis extending parallel to said surfaces;

a coiled spring structure extending normal to said first surface and having an axis when said spring structure is in a relaxed state which intersects said pivotable member at a location displaced from said pivot axis;

said coiled spring structure having one end permanently attached to said pivotable member and having a free end formed into a termination means for engaging said switch control member;

said termination means comprising a first lug extending from said free end and having a pivot surface spaced from a surface of said switch control member around which said termination means pivots, and at least a second lug extending from said free end against which said switch contact member surface engages such that said at least said second lug causes said spring structure to buckle in a predetermined direction when said control member is depressed, said pivot surface extends generally parallel to said pivot axis and generally perpendicular to said axis of said coiled spring structure.

2. The switch activator of claim 1 wherein said pivotable member and said coiled spring structure are one integral member.

3. The switch activator of claim 2 wherein said coiled spring structure is limited in length to prevent a preload in excess of the weight of the switch control member, when assembled with a membrane switch and said switch control member.

4. The switch activator of claim 2 wherein said pivot surface is positioned displaced from said axis of said coiled spring structure, in the direction of desired buckle of said coil spring structure, in an amount of less than a smallest radial measurement from said axis of said coiled spring structure to any rectilinear segment of said structure.

5. A switch structure comprising a keybutton, a closable switch, and a plastic coil spring having two ends wherein said spring is integral with a plastic pivot member, said spring comprising a termination means located at an end distal from said pivot member comprised of at least a pair of lugs, one of said lugs having a bearing surface for receiving said keybutton for defining buckling of said spring in one direction when said spring is compressed by said keybutton such that a torque is applied by said spring on said pivot member wherein said member pivots to operate said closable switch.

6. A switch activator for closing contacts of a membrane switch in response to movement of a switch control member toward said membrane switch, comprising:

a pivotable member having a first and a second surface and a pivot axis extending parallel to said surfaces;

a coiled spring structure extending normal to said first surface and having an axis when said spring structure is in a relaxed state which intersects said pivotable member at a location displaced from said pivot axis;

said coiled spring structure having one end permanently attached to said pivotable member and having a free end formed into a termination means for engaging said switch control member;

said termination means comprising a pivot surface around which said termination means pivots, wherein said pivot surface engages a surface on said switch control member, said pivot surface extending generally parallel to said pivot axis and generally perpendicular to said axis of said coiled spring structure, wherein said coiled spring structure comprises a plurality of rectilinear segments interconnected by stepped segments to form said coil spring structure.

7. The switch activator of claim 6 wherein said rectilinear segments are arranged so that segments forming two sides of said coiled spring structure are parallel to said pivot axis.

8. The switch activator of claim 7 wherein said coil spring structure has a spacing between adjacent coils and said rectilinear segments have a thickness of less than said spacing.

9. The switch activator of claim 6 wherein said coil spring structure has a spacing between adjacent coils and said rectilinear segments have a thickness of less than said spacing.

* * * * *